US008297743B2

(12) United States Patent
Koizumi et al.

(10) Patent No.: US 8,297,743 B2
(45) Date of Patent: Oct. 30, 2012

(54) DROPLET EJECTION HEAD AND METHOD OF MANUFACTURING COATED BODY

(75) Inventors: Hiroshi Koizumi, Hiratsuka (JP); Shizuo Kinoshita, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 153 days.

(21) Appl. No.: 12/873,605

(22) Filed: Sep. 1, 2010

(65) Prior Publication Data

US 2011/0063378 A1 Mar. 17, 2011

(30) Foreign Application Priority Data

Sep. 17, 2009 (JP) ..... 2009-215299

(51) Int. Cl.
*B41J 2/045* (2006.01)

(52) U.S. Cl. ..... 347/70

(58) Field of Classification Search ..... 347/68, 347/70–72

See application file for complete search history.

(56) References Cited

U.S. PATENT DOCUMENTS

| | | | |
|---|---|---|---|
| 4,439,780 | A | 3/1984 | DeYoung et al. |
| 4,459,601 | A | 7/1984 | Howkins |
| 5,966,148 | A | 10/1999 | Rogers et al. |
| 6,378,982 | B2 | 4/2002 | Ono et al. |
| 6,679,586 | B2 | 1/2004 | Kobayashi et al. |
| 6,746,095 | B2 | 6/2004 | Kobayashi et al. |
| 7,677,691 | B2 | 3/2010 | Kinase et al. |
| 7,845,771 | B2 | 12/2010 | Koizumi |
| 2008/0074474 | A1 | 3/2008 | Yoo et al. |

FOREIGN PATENT DOCUMENTS

| | | |
|---|---|---|
| JP | 4-94944 | 3/1992 |
| JP | 6-218916 | 8/1994 |
| JP | 7-266556 | 10/1995 |
| JP | 2002-103627 | 4/2002 |
| JP | 2003-94685 | 4/2003 |
| JP | 2007-244973 | 9/2007 |
| JP | 2008-6418 | 1/2008 |
| JP | 2008-80806 | 4/2008 |
| JP | 2010-114218 | 5/2010 |

OTHER PUBLICATIONS

Office Action issued May 24, 2011 in Japanese Patent Application No. 2009-215229 (with English translation).

*Primary Examiner* — Matthew Luu
*Assistant Examiner* — Lisa M Solomon
(74) *Attorney, Agent, or Firm* — Oblon, Spivak, McClelland, Maier & Neustadt, L.L.P.

(57) ABSTRACT

According to one embodiment, a droplet ejection head includes a liquid room, chambers, piezo elements, restrictors, movable pieces, and actuators. The liquid room stores a liquid. The chambers are supplied with the liquid from the liquid room and include nozzles for ejecting the supplied liquid in a droplet state. The piezo elements can be displaced in directions so as to change contents of the chambers. The restrictors bring the liquid room and the chambers in communication with each other. The movable pieces are movable in directions so as to change flow-path areas of the restrictors. The actuators move the movable pieces in the directions so as to change the plow-path areas of the restrictors.

6 Claims, 3 Drawing Sheets

DROPLET EJECTION HEAD AND METHOD OF MANUFACTURING COATED BODY

CROSS REFERENCE TO RELATED ART

This application is based upon and claims the benefit of priority from Japanese Patent Application No. 2009-215299, filed on Sep. 17, 2009; the entire contents of which are incorporated herein by reference.

FIELD

The present embodiment relates to a droplet ejection head for ejecting droplets and a method of manufacturing a coated body.

BACKGROUND

In a conventional droplet ejection device for ejecting a liquid such as ink in a droplet state and performing a coating operation, a printing operation, or the like, a droplet ejection head (such as an inkjet head) has been used, in which droplets are ejected from nozzles by use of displacement of piezo elements. As for the droplet ejection head, a patent publication described below has been known.

An inkjet head described in Patent Publication 1 (U.S. Pat. No. 4,439,780) includes chambers including orifices for ejecting ink (corresponding to nozzles in the present embodiment), transducers (corresponding to piezo elements in the present embodiment) configured to expand and contract so as to change a content of each chamber by applying voltage, an ink reservoir for storing ink (corresponding to a liquid room in the present embodiment), and restricted openings (corresponding to restrictors in the present embodiment) through which the ink reservoir and the chamber are in communication with each other.

In the conventional inkjet head, ink is ejected in the chambers from the orifices by causing the transducers to expand and contract and applying pressure to the ink in the chambers. Then, the same amount of ink as the ejected ink is supplied into the chambers from the ink reservoir via the restricted openings. Note that, a flow-path area of each restricted opening is configured to be small in order to prevent the ink in the chambers from flowing back to an ink reservoir side when pressure is applied to the ink in the chambers by causing the transducers to expand and contract.

In the conventional inkjet head described in Patent Publication 1, when air bubbles enter the chambers, an ejection property of the ink from the orifices is lowered if the air bubbles are not removed. As a result, the ink may not be ejected from the orifices. In such a case, the ink in each chamber is flown out through the orifices with the air bubbles by applying pressure to ink in the ink reservoir and transmitting the increased pressure to the ink in the chambers. However, the conventional inkjet head has a small flow-path area of each restricted opening. Consequently, the increased pressure in the ink reservoir cannot be transmitted directly to the ink in the chambers. Thus, it may be difficult to bring the air bubbles out from the orifices with the ink.

DETAILED DESCRIPTION

In general, according to one embodiment, a droplet ejection head includes a liquid room, chambers, piezo elements, restrictors, movable pieces, and actuators. The liquid room stores a liquid. The chambers are supplied with a liquid from the liquid room, and include nozzles for ejecting the supplied liquid in a droplet state. The piezo elements can be displaced in directions so as to change a content of each of the chambers. The restrictors bring the liquid room and the chambers in communication with each other. The movable pieces can be displaced in directions so as to change a flow-path area of each of the restrictors. The actuators move the movable pieces in the directions so as to change the flow-path area of each of the restrictors.

Hereinafter, one embodiment will be explained with reference to the drawings.

Figure 1:
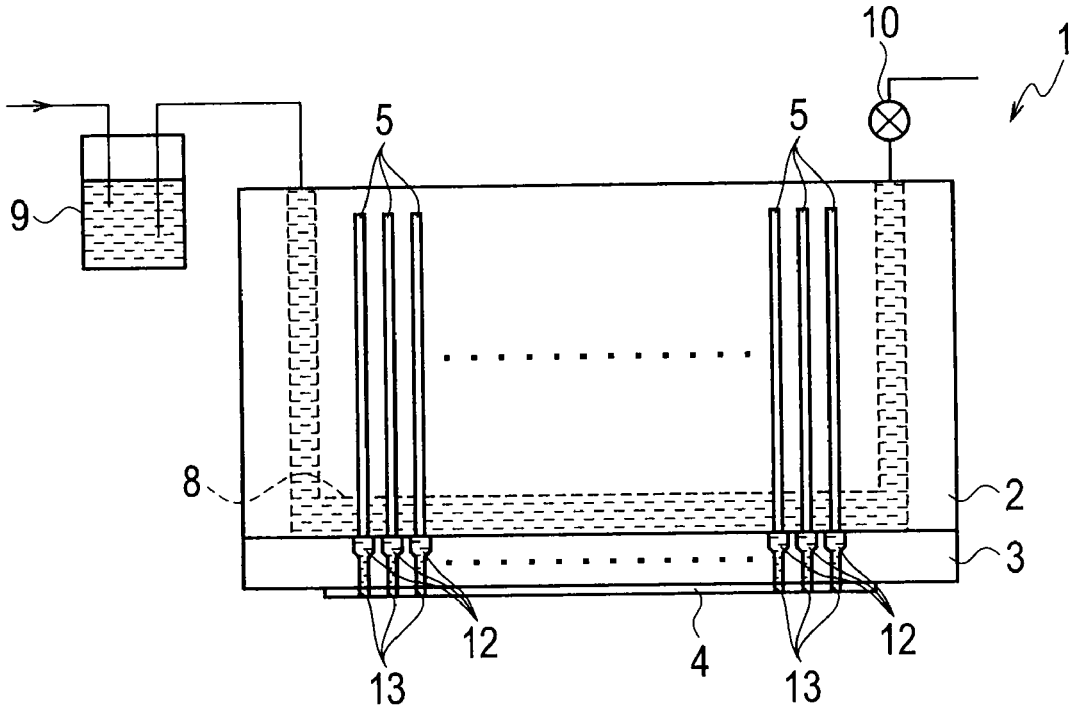
FIG. 1 is a vertical sectional front view illustrating a droplet ejection head according to one embodiment.
Figure 2:
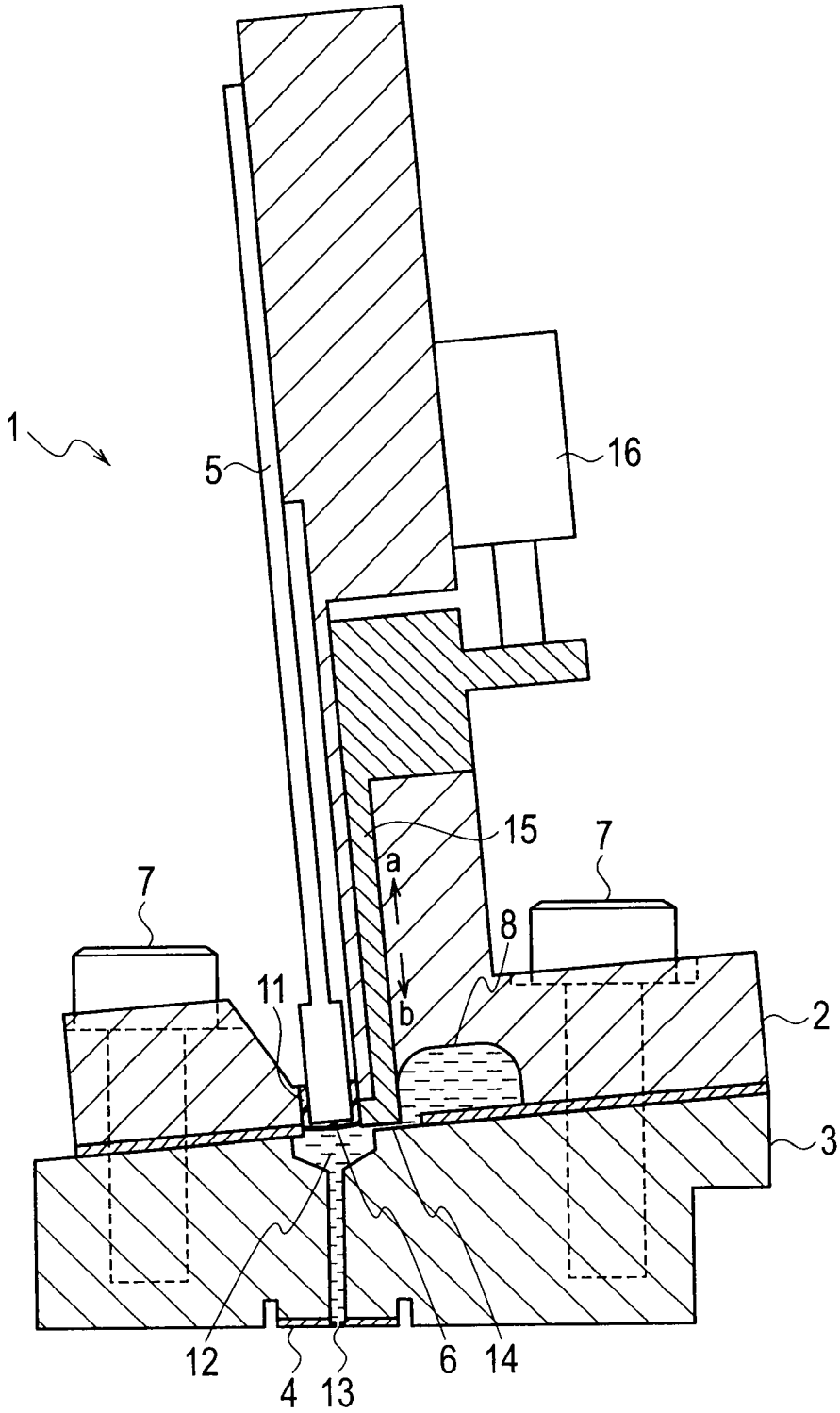
FIG. 2 is a vertical sectional side view of FIG. 1.

A droplet ejection head 1 according to the present embodiment illustrated in FIGS. 1 and 2 is used in and attached to a droplet ejection device (not illustrated in the figure) for ejecting a liquid in a droplet state so as to perform a coating operation, a printing operation, or the like. The droplet ejection head 1 includes a first base body 2, a second base body 3, a nozzle plate 4, a plurality of piezo elements 5, and a plurality of flexible diaphragms 6. The first base body 2 and the second base body 3 are fixed to each other by fixing bolts 7. The second base body 3 is provided with the nozzle plate 4 adhered thereto and having a plurality of nozzles 13.

The first base body 2 is provided with a liquid room 8 formed extending along a longitudinal direction of the first base body 2. The liquid room 8 is filled with a liquid (such as ink). One end of the liquid room 8 is connected to a liquid tank 9 as a liquid supply unit for supplying the liquid to the liquid room 8. The other end of the liquid room 8 is connected to an outlet valve 10. The outlet valve 10 is opened at an initial filling of the liquid to the liquid room 8 and at a cleaning in the droplet ejection head 1. Meanwhile, the outlet valve 10 is closed during the rest of the time.

The first base body 2 is provided with the piezo elements 5 attached thereto along a longitudinal direction of the liquid room 8. The first base body 2 is provided with the diaphragms 6 attached thereto and composing a part of a peripheral wall of each chamber described later. One end of each piezo element 5 is fixed to each diaphragm 6 by use of silicone adhesive agent 11 as elastic body.

The second base body 3 is provided with a plurality of chambers 12 arranged along a longitudinal direction of the second base body 3. Each of the chambers 12 is supplied with the liquid in the liquid room 8 via restrictors 14 described later.

The nozzles 13 are formed in the nozzle plate 4. When the nozzle plate 4 is attached to the second base body 3, each of the nozzles 13 is communicated with each of the chambers 12 concerned. The nozzles 13 are provided so as to be located directly below the chambers 12.

When the first base body 2 and the second base body 3 are fixed to each other using the bolts 7, the restrictors 14 for bringing the liquid room 8 and the chambers 12 in communication with each other are formed between the first base body 2 and the second base body 3. When the droplet ejection head 1 is attached to the droplet ejection device, each of the restrictors 14 is formed to be inclined so that the liquid room 8 is located in a higher position than the chambers 12 as illustrated in FIG. 2.

The first base body 2 is provided with a plurality of movable pieces 15 and actuators 16. The movable pieces 15 compose a part of a peripheral wall of each restrictor 14, and are movable in directions so as to change a flow-path area of each of the restrictors 14 (directions of an arrow "a" and an arrow "b" illustrated in FIG. 2). One end of each of the actuators 16 is connected to each of the movable pieces 15 concerned, and the actuators 16 are displaced by being applied with current, so as to move the movable pieces 15 in the directions to change the flow-path area of each of the restrictors 14.

Each of the chambers 12 is provided with one piezo element 5. Each of the chambers 12 is provided with one movable piece 15 and one actuator 16, respectively. As for the actuators 16, piezo elements can be employed.

In such a configuration, when droplets are ejected from the nozzles 13, voltage is applied to the piezo elements 5 provided to the chambers 12 communicated with the nozzles 13 intended to eject droplets, so that the piezo elements 5 are displaced in a direction to reduce contents of the corresponding chambers 12. Due to the displacement of the piezo elements 5, the diaphragms 6 are bent toward the chambers 12. Then, the contents of the chambers 12 are reduced, and pressure in the chambers 12 is increased. Accordingly, liquids in the chambers 12 are ejected from the nozzles 13 in a droplet state.

The droplets ejected from the nozzles 13 are coated to a to-be-coated object located to face the nozzles 13. By coating the droplets to the to-be-coated object, a coated body is manufactured.

Figure 3:
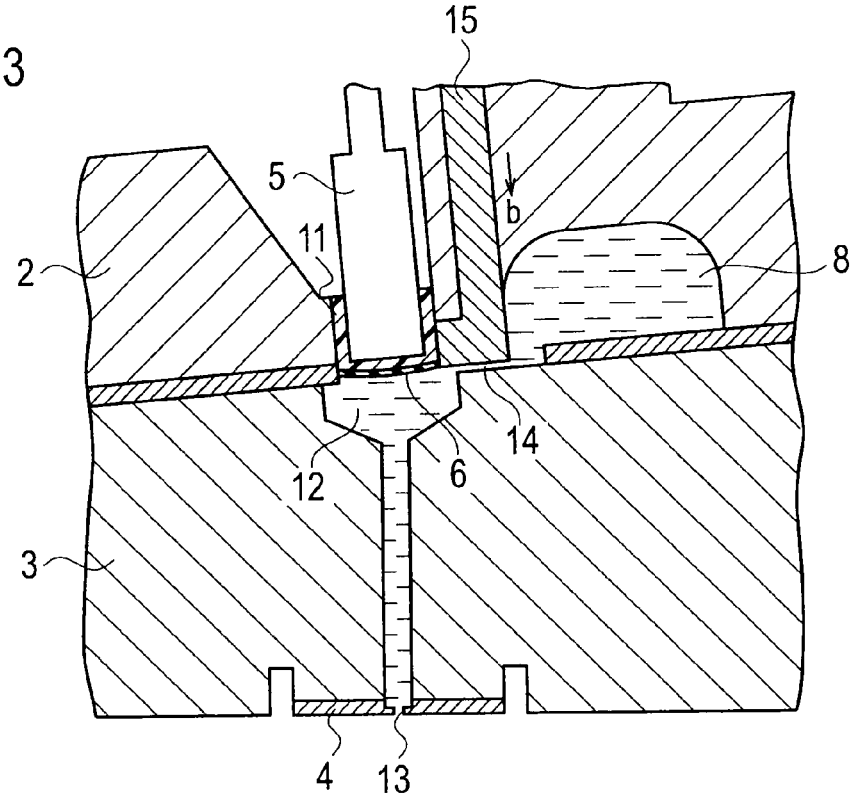
FIG. 3 is a cross sectional view in the case where a flow-path area of a restrictor of a droplet ejection head is small.

As illustrated in FIG. 3, when the ejection of the droplets from the nozzle 13 is in process, the movable piece 15 is positioned so as to reduce the flow-path area of the restrictor 14. Due to such a configuration, the liquid in the chamber 12 is prevented from flowing back to the liquid room 8 through the restrictor 14 even if the pressure in the chamber 12 is increased.

When air bubbles enter the chamber 12, an ejection property of the droplets from the nozzle 13 is lowered due to the entrance of the air bubbles in the chamber 12. In such a case, it is necessary to apply pressure from a side of the liquid tank 9 in order to increase pressure of the liquid in the liquid room 8 and the chamber 12, so that the air bubbles entering the chamber 12 are flown out through the nozzle 13 with the liquid in the chamber 12.

Figure 4:
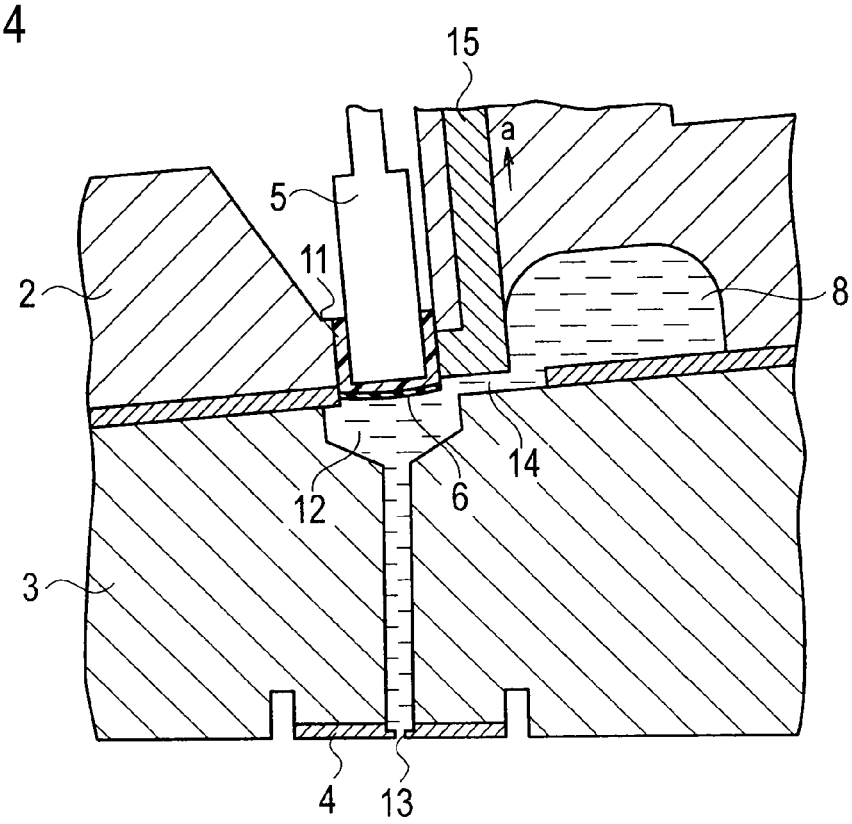
FIG. 4 is a cross sectional view in the case where a flow-path area of a restrictor of a droplet ejection head is large.

When the air bubbles entering the chamber 12 are flown out through the nozzle 13 with the liquid, the actuator 16 is driven so as to move the movable piece 15 in a direction of the arrow "a" as illustrated in FIG. 4. Thus, the flow-path area of the restrictor 14 is increased. Accordingly, the pressure applied to the liquid from the side of the liquid tank 9 is accurately transmitted to the chamber 12. As a result, the pressure in the chamber 12 is rapidly increased, and the air bubbles in the chamber 12 is easily flown out through the nozzle 13 with the liquid in the chamber 12. In addition, since the nozzle 13 is located directly below the chamber 12, almost no pressure loss in the chamber 12 is caused when the pressure is applied to the liquid from the side of the liquid tank 9. Therefore, the air bubbles in the chamber 12 are flown out through the nozzle 13 more smoothly with the liquid in the chamber 12.

Consequently, the air bubbles entering the chamber 12 can be easily removed, and the ejection property of the droplets from the nozzle 13 can be maintained in a good state.

After the air bubbles are flown out through the nozzle 13 with the liquid, the movable piece 15 is moved in a direction of the arrow "b" as illustrated in FIG. 3, so that the restrictor 14 has the small flow-path area again. Then, the ejection of the droplets from the nozzle 13 is restarted.

When the droplet ejection head 1 is attached to the droplet ejection device, the restrictors 14 are formed to be inclined so that the liquid room 8 is located in a higher position than the chambers 12. Therefore, when the air bubbles enter the chambers 12, the air bubbles are easily moved into the liquid room 8 through the restrictors 14. Thus, the ejection property of the droplets from the nozzles 13 is not rapidly lowered even when the air bubbles enter the chambers 12. Accordingly, the ejection property of the droplets from the nozzles 13 can be maintained in a good state over a long period of time without a process of bringing the air bubbles in the chambers 12 out from the nozzles 13 with the liquids.

One end of each of the piezo elements 5 is fixed to each of the diaphragms 6 by use of the silicone adhesive agent 11. Therefore, when the piezo elements 5 are displaced by applying voltage to the piezo elements 5, an oscillation of the displacement of each of the piezo elements 5 is lowered, thereby converging the oscillations of the piezo elements 5 in a short time. Thus, when the displacement of each of the piezo elements 5 is continuously performed by applying voltage, there is no residual oscillation influence, so that the mount of the displacement of each of the piezo elements 5 at each voltage application can be maintained constant. Accordingly, the amount of the droplets ejected at each voltage application can be maintained constant, and the droplet ejection with high accuracy can be achieved.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A droplet ejection head used in and attached to a liquid ejection device, comprising:

a liquid room for storing a liquid;

a chamber supplied with the liquid from the liquid room and including a nozzle for ejecting the supplied liquid in a droplet state;

a piezo element displaced in directions so as to change a content of the chamber;

a restrictor that brings the liquid room and the chamber in communication with each other;

a movable piece movable in directions so as to change a flow-path area of the restrictor; and an actuator for moving the movable piece in the directions so as to change the flow-path area of the restrictor, wherein the restrictor is inclined so that the liquid room is located in a higher position than the chamber when the droplet ejection head is attached to the liquid ejection device.

2. The droplet ejection head of claim 1, wherein the nozzle is located directly below the chamber.

3. The droplet ejection head of claim 1, further comprising:

a flexible diaphragm provided at a part of a peripheral wall of the chamber, wherein one end of the piezo element is fixed to the diaphragm via an elastic body.

4. The droplet ejection head of claim 3, wherein the elastic body is a silicone rubber.

5. The droplet ejection head of claim 1, further comprising:

a liquid supply unit connected to one end of the liquid room, the liquid supply unit for supplying the liquid to the liquid room.

6. A method of manufacturing a coated body, comprising:

coating droplets by ejecting toward a to-be-coated object by use of a droplet ejection head comprising a liquid room for storing a liquid, a chamber supplied with the liquid from the liquid room and including a nozzle for ejecting the supplied liquid in a droplet state, a piezo element displaced in directions so as to change a content of the chamber, a restrictor that brings the liquid room and the chamber in communication with each other, a movable piece movable in directions so as to change a flow-path area of the restrictor, and an actuator for moving the movable piece in the directions so as to change the flow-path area of the restrictor, wherein the restrictor is inclined so that the liquid room is located in a higher position than the chamber when the droplet ejection head is attached to the liquid ejection device.

* * * * *